US010145605B2

(12) United States Patent
Yang et al.

(10) Patent No.: US 10,145,605 B2
(45) Date of Patent: Dec. 4, 2018

(54) REFRIGERATOR

(71) Applicant: LG ELECTRONICS INC., Seoul (KR)

(72) Inventors: Changwoan Yang, Seoul (KR); Seungjin Choi, Seoul (KR); Hanhyo Kim, Seoul (KR); Yoomin Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/313,622

(22) PCT Filed: Feb. 12, 2016

(86) PCT No.: PCT/KR2016/001416

§ 371 (c)(1),
(2) Date: Nov. 23, 2016

(87) PCT Pub. No.: WO2016/129944

PCT Pub. Date: Aug. 18, 2016

(65) Prior Publication Data

US 2017/0350642 A1 Dec. 7, 2017

(30) Foreign Application Priority Data

Feb. 13, 2015 (KR) ..... 10-2015-0022199
Jan. 15, 2016 (KR) ..... 10-2016-0005605

(51) Int. Cl.
*F25D 25/02* (2006.01)
*F25D 23/02* (2006.01)
(Continued)

(52) U.S. Cl.
CPC ..... *F25D 25/025* (2013.01); *A47B 88/44* (2017.01); *F25D 23/02* (2013.01); *F25D 23/028* (2013.01); *F25D 23/067* (2013.01); *F25D 23/069* (2013.01)

(58) Field of Classification Search
CPC .... F25D 25/021; F25D 25/024; F25D 25/025; F25D 23/028; F25D 23/062; F25D 23/067; F25D 23/069; A47B 88/44
See application file for complete search history.

(56) References Cited

U.S. PATENT DOCUMENTS 2,724,630 A * 11/1955 Saunders ..... F25D 25/024 312/408
2,761,751 A * 9/1956 Stockton ..... F25D 25/024 312/274
(Continued)

FOREIGN PATENT DOCUMENTS

EP 2250929 A1 * 11/2010 ..... A47B 96/16
KR 2004045808 A 6/2004
(Continued)

OTHER PUBLICATIONS

International Search Report and Written Opinion in International Application No. PCT/KR2016/001416, dated Jun. 16, 2016, 8 pages.

*Primary Examiner* — Daniel J Troy
*Assistant Examiner* — Ryan A Doyle
(74) *Attorney, Agent, or Firm* — Fish & Richardson P.C.

(57) ABSTRACT

The refrigerator includes item storage units arranged in multiple layers in a storage compartment, horizontal frames arranged in multiple layers, the horizontal frames respectively supporting the item storage units, a vertical frame coupled to each of the horizontal frames, the vertical frame extending vertically, first rail units arranged in multiple layers, the first rail units respectively supporting the horizontal frames so that the horizontal frames is movable in a front-to-back direction relative to the storage compartment, a link to connect any one of the horizontal frames arranged and the door to each other so as to move the horizontal frames in the front-to-back direction in response to rotation
(Continued)

of the door, and a second rail unit located between the item storage unit and the horizontal frame arranged in the same layer so as to movably support the item storage unit in the front-to-back direction.

8 Claims, 10 Drawing Sheets

(51) Int. Cl.
*A47B 88/44* (2017.01)
*F25D 23/06* (2006.01)

(56) References Cited

U.S. PATENT DOCUMENTS 3,339,994 A * 9/1967 Reddig ..... F25D 25/021 211/126.15
4,735,470 A * 4/1988 Falk ..... F25D 25/021 312/246
5,299,863 A * 4/1994 Albright, Jr. ..... F25D 25/024 312/404
7,712,852 B2 * 5/2010 Choi ..... F25D 25/025 312/301
7,766,437 B2 * 8/2010 Lim ..... F25D 25/024 312/330.1
8,864,250 B2 * 10/2014 Anderson ..... F25D 25/025 312/330.1
9,217,602 B2 * 12/2015 Lee ..... F25D 25/02
9,726,423 B1 * 8/2017 Swarnkar ..... F25D 25/024
2013/0257755 A1 * 10/2013 Cai ..... G06F 3/147 345/173
2017/0227280 A1 * 8/2017 Yang ..... F25D 25/025
2017/0227281 A1 * 8/2017 Yang ..... F25D 25/025
2017/0234607 A1 * 8/2017 Yang ..... A47B 88/453 312/408

FOREIGN PATENT DOCUMENTS

KR 2005060115 A 6/2005
KR 10-2005-0118585 12/2005
KR 10-0901022 6/2009
KR 2010-0130357 12/2010
KR 10-2011-0037553 4/2011
KR 2011046237 A 5/2011
KR 10-2013-0114991 10/2013

* cited by examiner

【Figure 8】
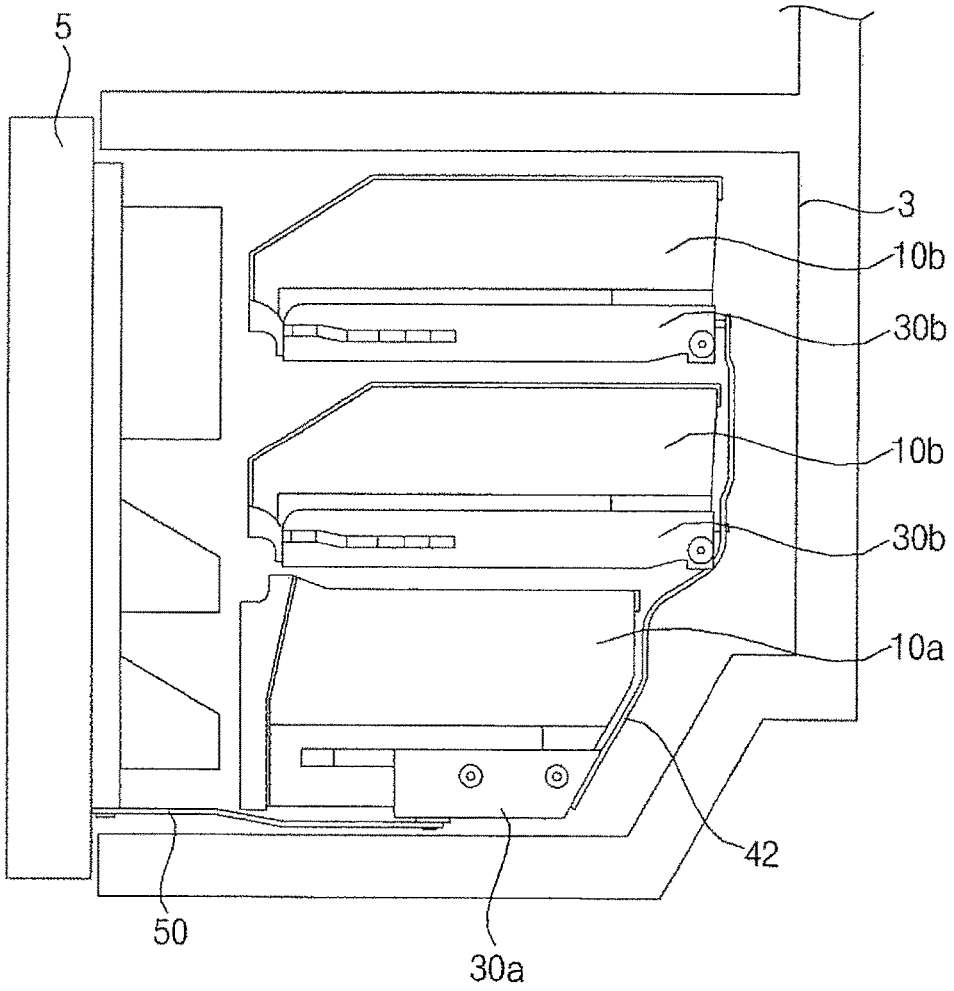

【Figure 9】
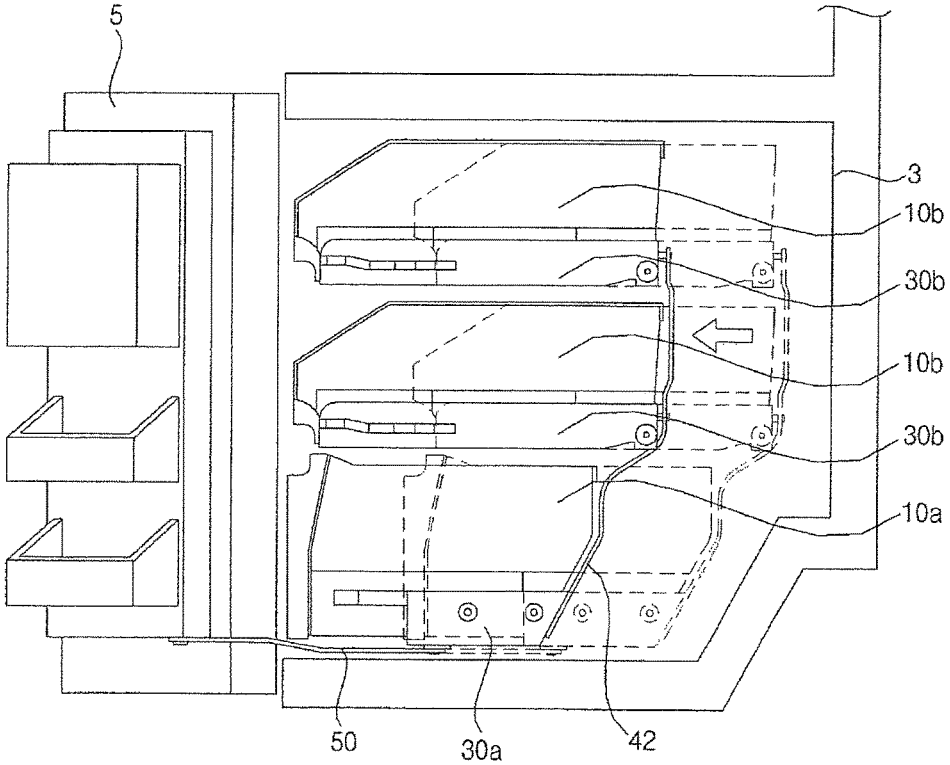

【Figure 10】
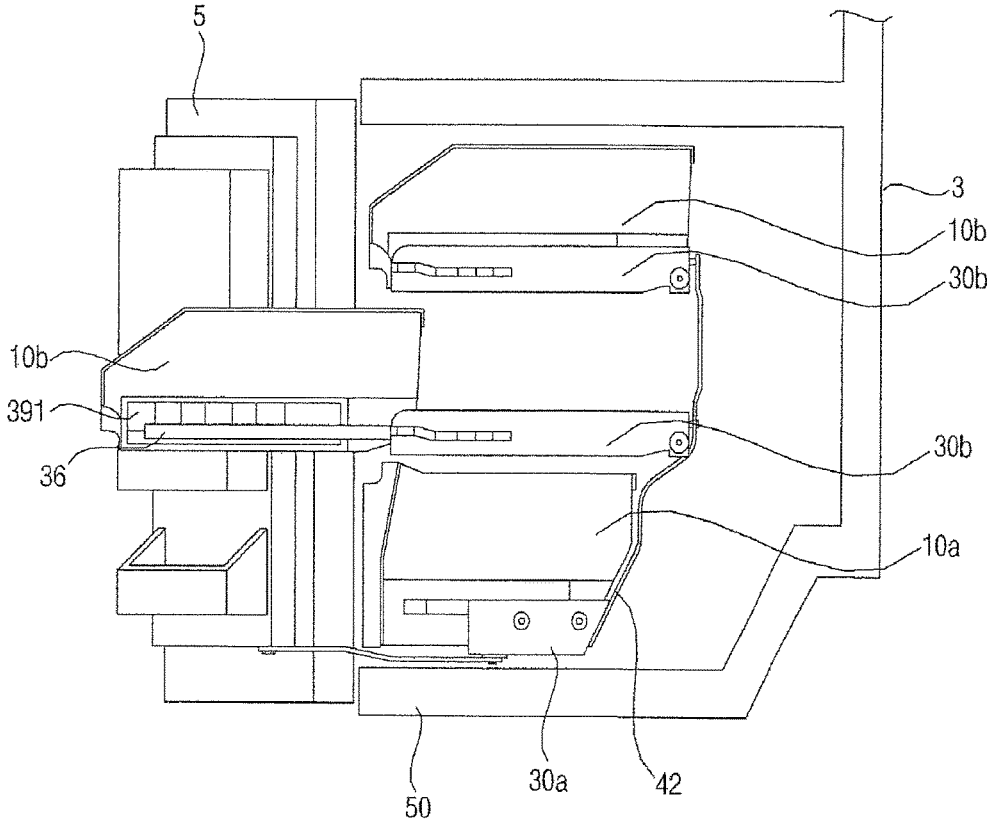

REFRIGERATOR

CROSS REFERENCE TO RELATED APPLICATIONS

This application is a U.S. National Phase Application under 35 U.S.C. § 371 of International Application PCT/KR2016/001416, filed on Feb. 12, 2016, which claims the benefit of Korean Application No. 10-2015-0022199, filed on Feb. 13, 2015, and Korean Application No. 10-2016-0005605, filed on Jan. 15, 2016, the entire contents of which are hereby incorporated by reference in their entireties.

TECHNICAL FIELD

The present invention relates to a refrigerator which enhances convenience in user identification and retrieval of items and the efficiency of storage and cooling thereof, and more particularly, to a refrigerator in which items are retrieved in connection with the opening operation of a door.

BACKGROUND ART

A refrigerator is an electronic appliance that is used to store items (e.g. food and containers) at freezing or lower temperatures or at a temperature slightly above freezing.

Although there are various method of opening and closing a storage compartment (i.e. a freezing compartment or a refrigerating compartment) defined in the refrigerator, the opening and closing methods are generally classified into a method using a hinged door (e.g., a single door or double doors), provided at the front side of the storage compartment, and a method using a sliding door provided at the top side of a drawer type storage compartment, which is able to be wholly introduced into or discharged from the refrigerator.

Among these, a hinged door type refrigerator may include, for example, a home bar, an icemaker, a shelf, or a box mounted on the rear surface of the door. In the case of this type of refrigerator, when the door is closed, the front end of a item storage unit (e.g. a shelf, a drawer or a box) that is provided inside the storage compartment may interfere with the constituent elements mounted on the rear surface of the door (e.g. the home bar, icemaker, shelf or box).

In order to solve the interference described above, the front end of the item storage unit that is provided inside the storage compartment is located at a position spaced apart rearward from the front end of the storage compartment by a prescribed distance. However, in this case, the user needs to suffer the inconvenience of placing his/her hand deep inside the storage compartment in order to retrieve items placed in the item storage unit and has difficulty in visually identifying items stored in the rear region of the storage compartment. In particular, when the refrigerator is large, and thus has a long front-to-back length, the inconvenience of the user is worsened.

As efforts to remove the inconvenience of the user described above, a refrigerator has been developed, which includes a frame, which is movable in the front-to-back direction and supports item storage units arranged in multiple layers inside the storage compartment, and a link assembly, which connects the movable frame to a hinged door. In this case, when the door is opened, the movable frame is moved forward so as to move the item storage units forward.

The related art has a limitation as to the distance by which the movable frame is movable forward relative to the storage compartment. That is, even if the door is completely opened, the movable frame is adapted to stop when the front end of the item storage unit approaches the front end of the storage compartment. This is because the constituent elements on the rear surface of the door are mounted so as to protrude from the rear surface of the door by a prescribed distance, and therefore the protruding constituent elements may still be located in the forward movement path of the item storage unit and interfere with the item storage unit even after the door is opened. In addition, assuming that the movable frame protrudes beyond the front end of the storage compartment, the structure of a connecting portion between the movable frame and the item storage unit supported by the movable frame becomes unstable, which results in a requirement for excessively increased structural strength.

Frictional force, which prevents the movable frame from moving forward, is theoretically proportional to the sum of the weight of the movable frame and the load applied to the movable frame by the item storage unit and items stored therein.

In the case where the movable frame supports the item storage units that are arranged in multiple layers as in the related art, the weight of the movable frame is necessarily increased. This is because the number of members constituting the movable frame or the cross section of each member needs to be increased in order to ensure that the movable frame stably supports the loads of the item storage units arranged in multiple layers and the items stored therein. When the weight of the movable frame increases, consequently, the frictional force caused by the movement of the movable frame increases.

In the related art, the movable frame is supported by guide rails which are secured to the inner surface of the storage compartment. The guide rails guide the movement of the movable frame in the front-to-back direction.

RELATED ART DOCUMENT

Patent Document

Korean Patent Laid-Open Publication No. 2010-0130357 (Dec. 13, 2010).

DISCLOSURE OF INVENTION

Technical Problem

It is a first object of the present invention to solve problems of the related art in which the movable frame of the related art has a limitation as to the forward movement distance thereof, and therefore the user needs to inconveniently place his/her hand deep inside the storage compartment in order to retrieve items placed in the item storage unit, and has difficulty in visually identifying items stored in the rear region of the storage compartment.

In addition, it is a second object of the present invention to solve problems of the related art in which, in the configuration of the related art, in which the item storage units are arranged in multiple layers, frictional force caused by the movement of the movable frame increases because of the great weight of the movable frame, and therefore, the refrigerator including the link assembly causes the user to exert greater effort when opening the door, and even in the case where the movable frame is moved by electric power, a high-capacity power unit is required, or great power loss occurs.

In addition, it is a third object of the present invention to solve problems of the related art in which the space occupied by the movable frame increases when the number of members constituting the movable frame or the cross section of each member increases, and therefore the space inside the storage compartment for the storage of items decreases and the circulation of cold air inside the storage compartment is obstructed, causing deteriorated cooling efficiency.

In addition, it is a fourth object of the present invention to solve problems of the related art in that the movable frame of the related art is supported by the guide rails, and therefore a load is concentrated on the guide rails, which increases the possibility of damage or deformation of the guide rails.

The objects of the present invention are not limited to the aforementioned object, and other objects not mentioned above will be clearly understood from the following description by those skilled in the art.

Solution to Problem

To achieve the above described object, in accordance with one aspect of the present invention, there is provided a refrigerator including an outer cabinet, an inner cabinet to define a storage compartment having a front opening, a door to open or close the opening, and item storage units arranged in multiple layers, the item storage units being accommodated in the storage compartment and allowing items to be placed thereon.

The refrigerator further includes horizontal frames arranged in multiple layers, the horizontal frames respectively supporting the item storage units arranged in multiple layers, and a vertical frame coupled to each of the horizontal frames arranged in multiple layers, the vertical frame extending vertically.

The refrigerator further includes first rail units arranged in multiple layers, the first rail units respectively supporting the horizontal frames so that the horizontal frames is movable in a front-to-back direction relative to the storage compartment.

The refrigerator further includes a link to connect any one of the horizontal frames arranged in multiple layers and the door to each other so as to move the horizontal frames in the front-to-back direction in response to rotation of the door, and a second rail unit located between the item storage unit and the horizontal frame arranged in the same layer so as to movably support the item storage unit in the front-to-back direction.

In the refrigerator, the item storage units may respectively have a front end located in the same vertical plane as the opening or located at a rear side of the opening in a state in which the horizontal frames are moved forward to the maximum extent.

The item storage units may be selectively separably connected to the respective horizontal frames.

At least two of the first rail units may be arranged on opposite sides of the horizontal frame so as to support the horizontal frame.

At least one of the first rail units may include a support bar secured to a side surface of the storage compartment.

At least one of the first rail units may include a cantilever secured to a rear surface of the storage compartment.

The link may be provided to connect a lowermost horizontal frame, among the horizontal frames arranged in multiple layers, to the door.

The vertical frame may include a rear frame vertically oriented on a rear side of the horizontal frame.

The rear frame may include two vertical bars arranged on opposite sides of the horizontal frame.

The vertical bars may have a thickness in the front-to-back direction and a width in a left-and-right direction, the width being greater than the thickness.

The inner cabinet may protrude forward from a lower portion of a rear surface of the storage compartment so that the rear surface of the storage compartment is curved. And, the rear frame may be curved into a shape corresponding to the rear surface of the storage compartment.

Details of other embodiments are included in the following description and the drawings.

Advantageous Effects of Invention

Through the technical solution described above, it is possible to increase the convenience of user identification and retrieval of items stored in a refrigerator, to increase the efficiency of storage and cooling of the refrigerator, and to improve the durability of the refrigerator.

According to the present invention, by providing a horizontal frame and a item storage unit, which are movable forward, it is possible to assist the user in conveniently identifying and retrieving items stored deep inside the storage compartment.

In addition, according to the present invention, as first rail units supports the horizontal frame so as to support the item storage unit, it is possible to reduce the weight of a vertical frame structure, and consequently, to reduce frictional force, which obstructs the forward and rearward movement of the horizontal frame.

In addition, according to the present invention, as the volume of the vertical frame structure is reduced, it is possible to increase the storage space inside the storage compartment and to ensure more efficient circulation of cold air inside the storage compartment.

In addition, as the area that supports the horizontal frame is increased by the first rail unit so as to enable the distribution of a load, it is possible to reduce the risk of damage and deformation of a support unit caused by the concentration of a load.

The effects of the present invention are not limited to the above described effects, and other effects not mentioned above may be clearly understood by those skilled in the art from the description of the claims.

BRIEF DESCRIPTION OF DRAWINGS

The above and other objects, features and other advantages of the present invention will be more clearly understood from the following detailed description taken in conjunction with the accompanying drawings, in which:

FIG. 8 is a conceptual elevation view of the interior of the storage compartment, illustrating positions of the item storage units 10 and the horizontal frames 30 when the door 5 is closed in accordance with one embodiment of the present invention;

FIG. 9 is a conceptual elevation view of the interior of the storage compartment, illustrating positions of the item storage units 10 and the horizontal frames 30 when the door 5 is opened; and FIG. 10 is a conceptual elevation view of the interior of the storage compartment, illustrating positions of the item storage units 10 after being forwardly moved from the horizontal frames 30.

BEST MODE FOR CARRYING OUT THE INVENTION

The advantages and features of the present invention and the way of attaining them will become apparent with reference to embodiments described below in detail in conjunction with the accompanying drawings. Embodiments, however, may be embodied in many different forms and should not be construed as being limited to the example embodiments set forth herein. Rather, these example embodiments are provided so that this disclosure will be through and complete and will fully convey the scope to those skilled in the art. The scope of the present invention should be defined by the claims. Wherever possible, the same reference numbers will be used throughout the drawings to refer to the same or like parts.

Figure 1:
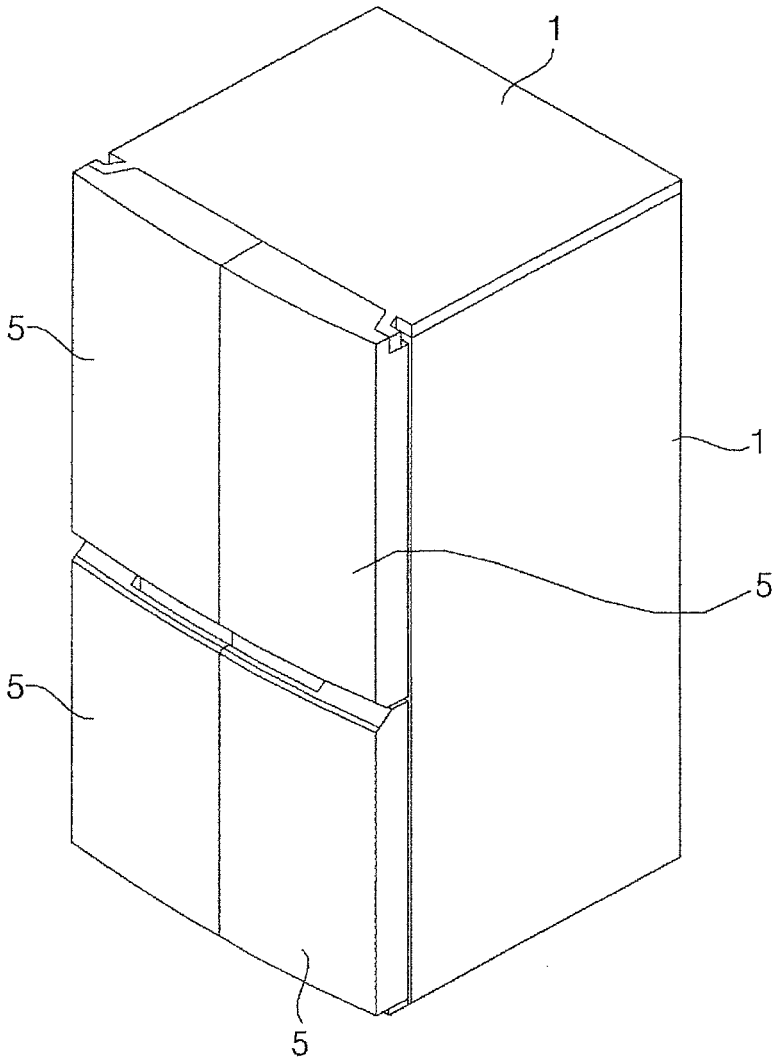
FIG. 1 is a perspective view illustrating the exemplary configuration of an outer cabinet 1 and doors 5 in the state in which the doors 5 of a refrigerator in accordance with one embodiment of the present invention are closed.
Figure 2:
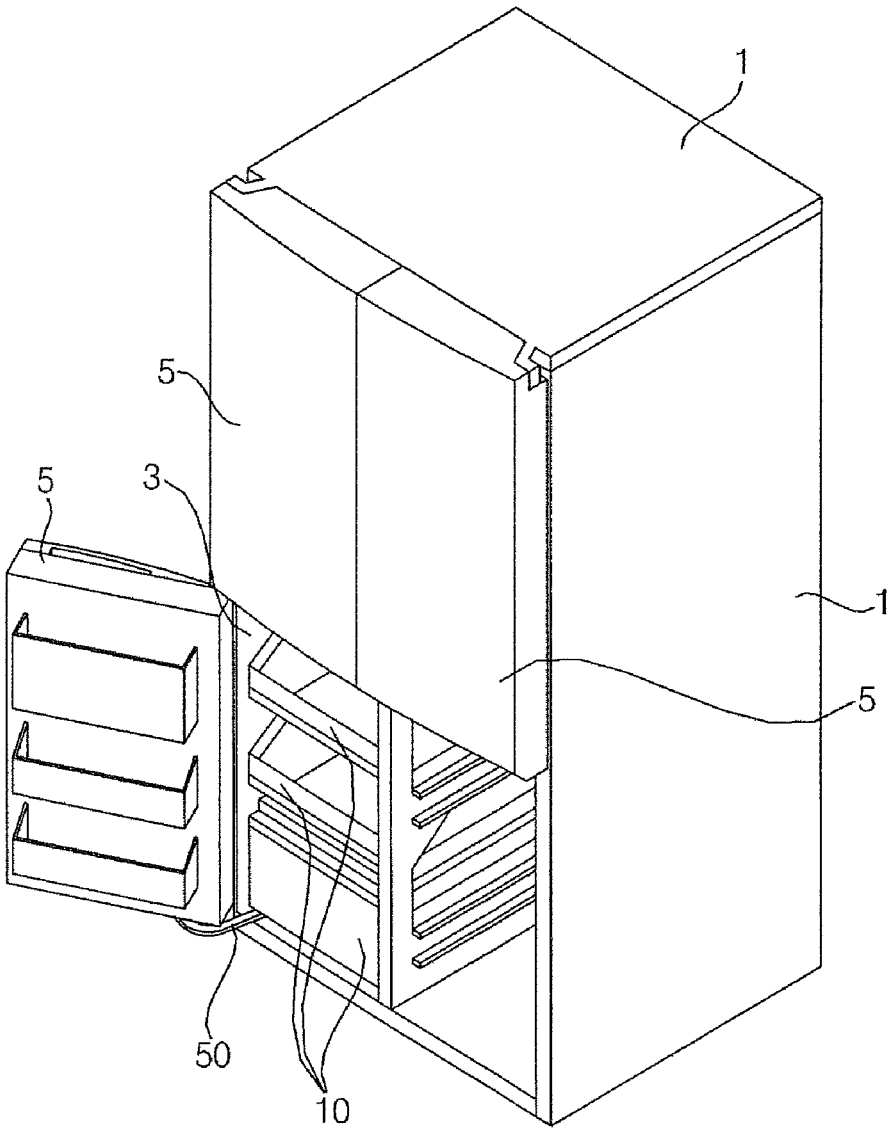
FIG. 2 is a perspective view illustrating the exemplary configuration of an inner cabinet 3 and item storage units 10 in the state in which the doors 5 of the refrigerator illustrated in FIG. 1 are opened.

FIG. 1 is a perspective view illustrating the exemplary configuration of an outer cabinet 1 and doors 5 in the state in which the doors 5 of a refrigerator in accordance with one embodiment of the present invention are closed, and FIG. 2 is a perspective view illustrating the exemplary configuration of an inner cabinet 3 and item storage units 10 in the state in which the doors 5 of the refrigerator illustrated in FIG. 1 are opened or omitted. Although the expressions that designate the directions "front", "rear", "left", "right", "upper" and "lower" mentioned hereinafter are defined on the basis whereby the side of the refrigerator, at which the door is located, is the front side and on the basis of the left side, the right side, the upper side and the lower side of the user when the user views the door from the outside, these are simply given to explain the present invention for clear understanding, and of course the respective directions may be defined in different ways depending on the reference point.

The refrigerator includes the outer cabinet 1, which defines the external appearance of the refrigerator, the inner cabinet 3, which is placed inside the outer cabinet 1 and defines a storage compartment having a front opening, and at least one hinged door 5 configured to close and open the opening.

The storage compartment is referred to as a refrigerating compartment in which, for examples, food and containers (hereinafter referred to as "items") are kept cold, or a freezing compartment in which items are kept frozen. The storage compartment mentioned hereinafter may be a freezing compartment or a refrigerating compartment as needed unless the embodiment is limited to the freezing compartment or the refrigerating compartment. Referring to FIGS. 1 and 2, a single refrigerator may include a plurality of storage compartments. The storage compartments may be vertically arranged separately from one another, or may be horizontally arranged separately from one another.

The inner cabinet 3 defines the ceiling surface, the bottom surface, the left and right side surfaces, and the rear surface of the storage compartment. The opening is formed in the front surface of the storage compartment.

In the overall description, the storage compartment is defined as a region that is opened or closed by each door 5. In the present embodiment, two upper doors 5 define upper left and right storage compartments respectively, and two lower doors 5 define lower left and right storage compartments respectively.

A partition 4, which is located to form any one side surface of the storage compartment, may divide a single space into two separated storage compartments. The partition 4 may be oriented to vertically cut the center of a single space so as to divide the single space into two left and right spaces. The partition 4 may have a partition aperture 4*a*, which connects the left and right spaces to each other. Cold air may move to the left and right storage compartments through the partition aperture 4*a*. As such, even if the partition 4 divides the single space into the left and right storage compartment, the circulation of cold air between the left and right storage compartments must not be completely blocked.

The partition 4 may provide a support location at which the items are supported. That is, the left side surface of the partition 4 serves as the right side surface of the left storage compartment, and the right side surface of the partition 4 serves as the left side surface of the right storage compartment.

In addition, the left and right storage compartments, relative to the partition 4, may be designed separately from each other. For example, the storage compartment at the left side of the partition 4 may be designed such that a drawer is located in the lower region and multiple layers of shelves are arranged in the upper region, and the storage compartment at the right side of the partition 4 may be designed such that drawers are arranged in three layers. That is, the design of the interior of the storage compartment may be varied to suit various user demands.

The present invention is applied to at least one of the storage compartments. In the present embodiment, the present invention is applied to the lower left storage compartment of the refrigerator, and the partition 4 is located to form the right side surface of the lower left storage compartment. The present invention may be applied to the other storage compartments, and may also be applied in the case where no partition is provided.

The refrigerator has an opening in the front side thereof. The opening is opened or closed by the hinged door 5. The door 5 may be a single hinged door, which is pivotably provided on either side of the front opening, or may include double hinged doors, which are pivotably provided at respective opposite edges of the front opening. In the case where the partition 4 is installed inside the storage compartment, the double hinged doors 5 may be installed to open or close the left and right storage compartments, divided by the partition 4, respectively. Although the following description of the present embodiment will be limited to the configuration in which the storage compartment door 5 includes double doors, the present invention may also be applied to the case where a single pivotable door is provided.

Figure 3:
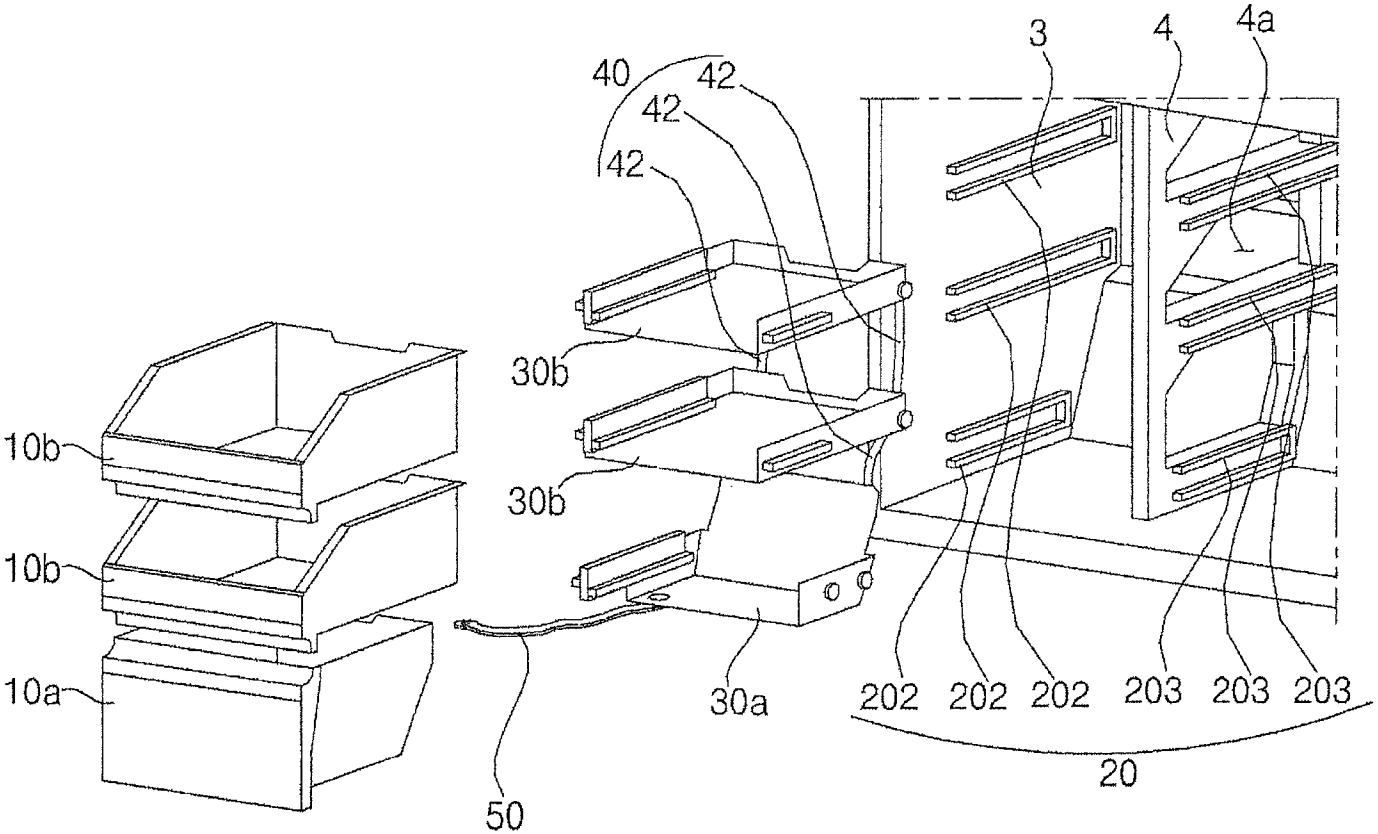
FIG. 3 is an exploded perspective view illustrating the item storage units 10 of FIG. 2 and horizontal frames 30, which are disassembled from the inner cabinet 3.

FIG. 3 is an exploded perspective view illustrating constituent elements provided in the storage compartment of FIG. 2. Referring to FIG. 3, the refrigerator includes item storage units 10 in multiple layers, which are accommodated inside the storage compartment and support items thereon, and horizontal frames 30 in multiple layers, which support the item storage units 10 in multiple layers respectively. The number of the horizontal frames 30 is equal to the number of the item storage units 10, and one of the horizontal frames 30 supports one of the item storage units 10 in the same layer.

The horizontal frames 30 are sorted into a lowermost horizontal frame 30*a*, which supports a lowermost item storage unit 10*a*, and upper horizontal frames 30*b*, which support one or more item storage units 10*b* located at the upper side.

The refrigerator includes a vertical frame 40, which is coupled to the respective horizontal frames 30 in multiple layers and extends vertically. That is, the vertical frame 40 is coupled to the lowermost horizontal frame 30*a* and the upper horizontal frames 30*b* and extends vertically.

In addition, the refrigerator includes first rail units 25 arranged in multiple layers. the first rail units respectively support the horizontal frames 30 so as to be movable relative to the storage compartment in the front-to-back direction. A set of the first rail units may be provided in each layer. The set of the first rail units refers to several first rail units in the same layer. The set of the first rail units may consist of two of the first rail units. The number of sets of the first rail units is equal to the number of the horizontal frames 30, and one of the sets of the first rail units supports one of the horizontal frames 30 in the same layer.

The first rail unit 25 includes a support unit 20 secured to the side surface of the storage compartment or the rear surface of the storage compartment.

In addition, the refrigerator includes a link 50, which connects any one of the multiple layers of horizontal frames 30 to the door 5 so as to move the multiple layers of horizontal frames 30 in the front-to-back direction in response to the rotation of the door 5. In the present embodiment, the link 50 is provided to connect the lowermost horizontal frame 30*a* and the door 5 to each other.

In addition, the refrigerator includes second rail units arranged in multiple layers. The second rail units respectively support the item storage units 10 so as to be movable relative to the horizontal frames 30 in the front-to-back direction. A set of the second rail units may be provided in each layer. The set of the second rail units refers to several second rail units in the same layer. The set of the second rail units may consist of two of the second rail units. The number of sets of the second rail units is equal to the number of the item storage units 10, and one of the sets of the second rail units supports one of the item storage units 10 in the same layer.

The second rail unit is located between the item storage unit 10 and the horizontal frame 30 and supports the item storage unit 10 so as to be movable in the front-to-back direction.

Figure 4:
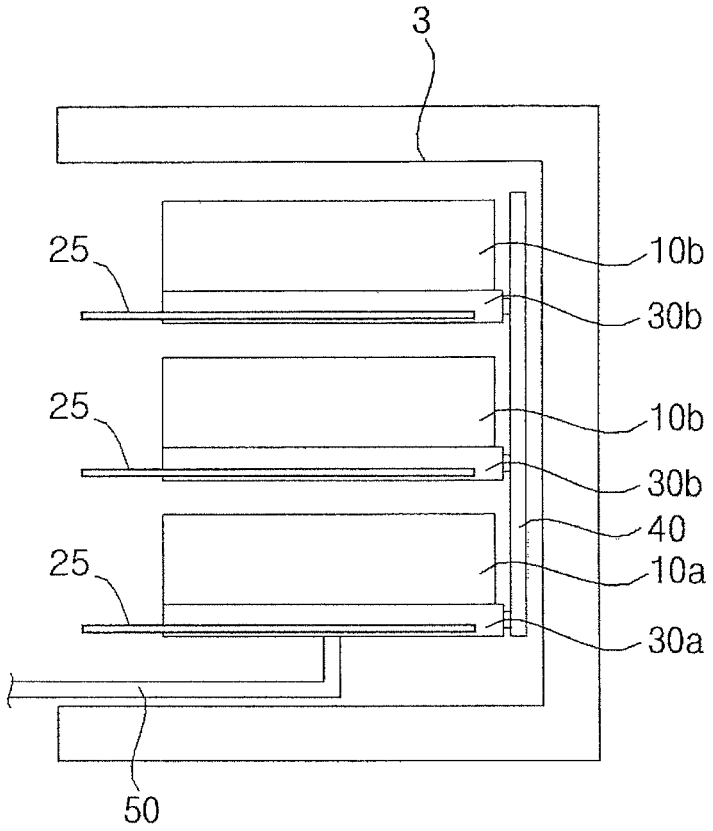
FIG. 4 is a conceptual side view illustrating the connection relationship between the item storage units 10 arranged in multiple layers, the horizontal frames 30 arranged in multiple layers, and a vertical frame 40 in accordance with one embodiment of the present invention.

Now, the connection relationship between the multiple layers of item storage units 10, the multiple layers of horizontal frames 30, and the vertical frame 40 in accordance with the present embodiment will be described with reference to FIG. 4. The horizontal frames 30 are provided to correspond to the multiple layers of item storage units 10 in a one-to-one ratio, and the link 50 is connected to the lowermost horizontal frame 30*a*. When the door 5 is pivoted to be opened, the link 50 pulls the lowermost horizontal frame 30 forward, and in turn the pulled lowermost horizontal frame 30*a* pulls the vertical frame 40 forward, and finally the pulled vertical frame 40 pushes the remaining layers of upper horizontal frames 30*b* forward. The vertical frame 40 is not required to support the horizontal frames 30, because the first rail units 25 support respectively support the horizontal frames 30.

Examples of the item storage unit 10 may include a shelf 101, a drawer 102, and a box (not illustrated). The shelf 101 refers to a structure generally having a plate shape, the drawer 102 refers to a container that is able to accommodate items therein and is slidable forward or rearward, and the box refers to a container that is able to accommodate items therein and has an opening that may be opened or closed.

Figure 5:
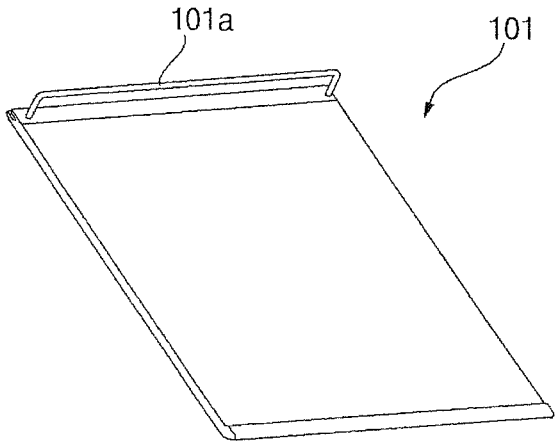
FIG. 5 is a perspective view illustrating different embodiments of the item storage unit 10 in accordance with the present invention, FIG. 5(*a*) illustrating a shelf 101, which is one embodiment of the item storage unit 10 and FIG. 5(*b*) illustrating a drawer 102, which is another embodiment of the item storage unit 10.
Figure 5:
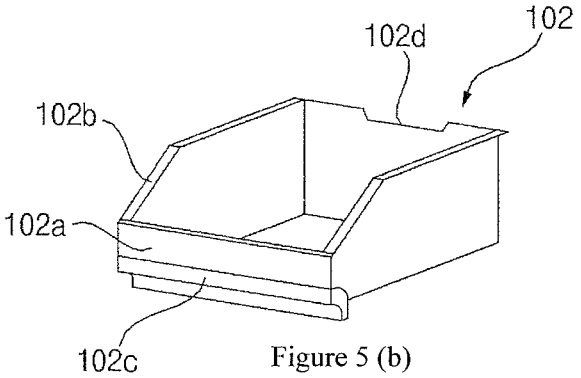

FIG. 5 is a perspective view illustrating different embodiments of the item storage unit 10 in accordance with the present invention. FIG. 5(*a*) illustrates the shelf 101, which is one embodiment of the item storage unit 10 and FIG. 5(*b*) illustrates the drawer 102, which is another embodiment of the item storage unit 10.

Although the shelf 101 may have any of various shapes to allow items to be placed thereon such as, for example, a plate shape, a mesh shape, or a densely arranged bar shape, in the embodiment of FIG. 5(*a*), the shelf 101 includes a shelf plate forming the bottom.

The shelf 101 may include a guard 101*a* to prevent items placed on the shelf plate from falling to the bottom surface of the storage compartment. The guard 101*a* may be formed by bending a bar having a prescribed cross-sectional area into an "n"-shape, and may be upright on the upper surface of the shelf plate. In another embodiment, a guard, which takes the form of a plate having the same width as the shelf 101 and a prescribed height, may be upright on the shelf plate.

When the shelf 101 is moved forward, the items placed thereon may fall rearward due to inertia or other shocks to thereby fall to the bottom surface of the storage compartment because the item storage unit 10 is movable forward. Therefore, the guard 101*a* may be provided on the rear end of the shelf 101.

In the embodiment of FIG. 5(*b*), the drawer 102 is able to be pulled forward and pushed rearward. The height of a front end portion 102*a* of the drawer 102 is smaller than the height of a rear end portion of the drawer 102. As such, a forwardly downwardly inclined portion 102*b* may be formed at the upper front portion of the drawer 102. With this configuration, even in the state in which the drawer 102 is pushed inward, the user can easily identify what is accommodated in the drawer 102. In particular, when the position of the eyes of the user is above the drawer 102, the user can easily identify the items inside the drawer 102 without having to pull the drawer 102 outward.

The drawer 102 may include a handle 102*c* on the lower portion of the front end portion 102*a*. The handle 102*c* may be located on the upper portion or the middle portion of the front end portion 102*a*.

In addition, a cold air guide 102*d* may be formed in the upper end of the drawer 102. The cold air guide 102*d* may be formed as a hole formed in the rear end portion of the drawer 102, or may be a recess formed by reducing the height of the upper end of the rear end portion by a prescribed length. The cold air guide 102*d* serves to guide cold air supplied from a cold air discharge hole so as to be introduced into the drawer 102 from the rear end portion.

The item storage unit 10 may be any one of the shelf 101, the drawer 102, and the box. In the case where the multiple layers of item storage units 10 are provided, shelves 101, drawers 102, and boxes may be combined with one another. The following description of the present embodiment is limited to the case where all of the item storage units 10 are drawers 102.

Figure 6:
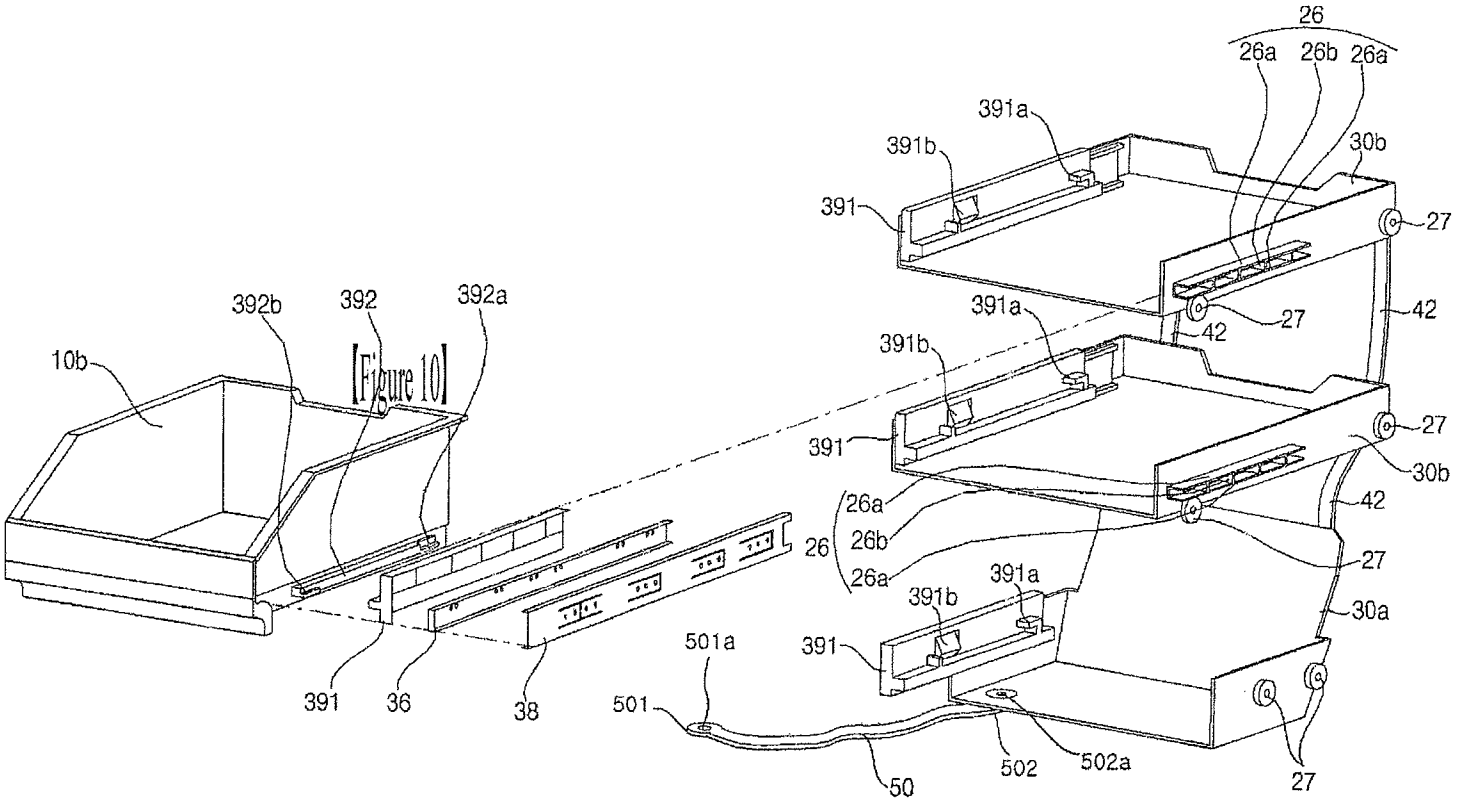
FIG. 6 is an exploded perspective view illustrating respective components of the horizontal frame 30 of FIG. 3, respective components of a second rail unit, and the item storage unit 10*b;*

Referring to FIGS. 3 and 6, at least two item storage units 10 are vertically arranged in multiple layers. Among these, the lowermost item storage unit 10*a* is directly supported by the lowermost horizontal frame 30*a*. At least one upper item storage unit 10*b* is provided. When a plurality of upper item storage units 10*b* is provided, the upper item storage units 10*b* are vertically arranged in multiple layers. The upper item storage units 10*b* are directly supported by the respective upper horizontal frames 30*b*.

The horizontal frame 30 is connected to the side surface of the storage compartment or the rear surface of the storage compartment so as to transfer a load thereto. The support unit 20 is provided on the side surface of the storage compartment or the rear surface of the storage compartment so as to support the horizontal frame 30. As described above, the side surface of the storage compartment is referred to not only one side surface of the inner cabinet 3, but also one side surface of the partition 4.

The item storage units 10 are arranged in multiple layers, the horizontal frames 30 are arranged in multiple layers so as to correspond to the respective item storage units 10, and a plurality of support units 20 is arranged in multiple layers so as to correspond to the respective horizontal frames 30.

The horizontal frame 30 directly supports the item storage unit 10 and receives the load of the item storage unit 10, and the support unit 20 directly supports the horizontal frame 30 and receives the loads of the item storage unit 10 and the horizontal frame 30. The support unit 20 transfers the loads to the side surface of the storage compartment or the rear surface of the storage compartment to which the support unit 20 is secured.

More specifically, the lowermost horizontal frame 30*a* directly supports the lowermost item storage unit 10*a* so as to receive the load of the lowermost item storage unit 10*a*, and the support unit 20 directly supports the lowermost horizontal frame 30*a* and receives the loads of the lowermost item storage unit 10*a* and the lowermost horizontal frame 30*a*. In addition, the upper horizontal frame 30*b*, located above the lowermost horizontal frame 30*a*, directly supports the upper item storage unit 10*b* located in the same layer so as to receive the load of the upper item storage unit 10*b*, and the support unit 20 directly supports the upper horizontal frame 30*b* so as to receive the loads of the upper item storage unit 10*b* and the upper horizontal frame 30*b*.

At least two support units 20 may support each horizontal frame 30 at opposite sides of the horizontal frame 30. In this case, at least two of the first rail units 25 are located at opposite sides of each horizontal frame 30 so as to support the horizontal frame 30. Specifically, the support units 20 may support opposite side surfaces of the horizontal frame 30. Alternatively, the support units 20 may be located on opposite portions of the lower surface of the horizontal frame 30 so as to support the horizontal frame 30. In addition, one support unit 20 may be located on either side surface of the horizontal frame 30, and the other support unit 20 may be located on an opposite portion of the lower surface of the horizontal frame 30, so as to support the horizontal frame 30.

Figure 7:
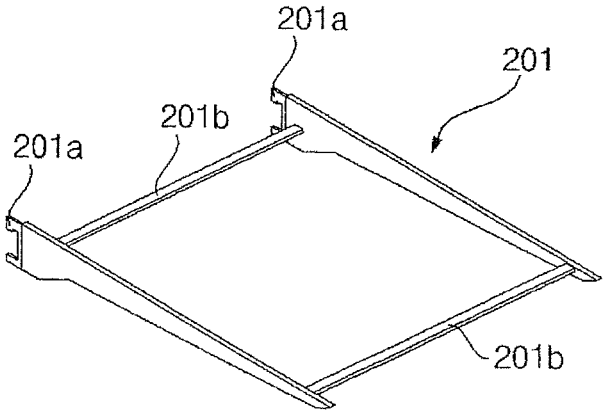
FIG. 7 is a perspective view illustrating different embodiments of support unit 20 of a first rail unit 25 in accordance with the present invention, FIG. 7(*a*) illustrating cantilevers 201, which are one embodiment of the support unit 20, and FIG. 7(*b*) illustrating support bars 202 or 203 secured to the side surface of a storage compartment, which are another embodiment of the support unit 20.
Figure 7:
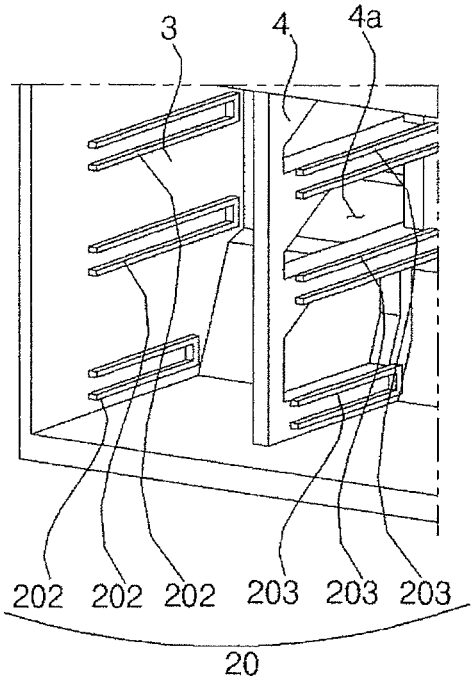

FIG. 7 is a perspective view illustrating different embodiments of the support unit 20 of the first rail unit 25 in accordance with the present invention. FIG. 7(*a*) illustrates cantilevers 201, which are one embodiment of the support unit 20, and FIG. 7(*b*) illustrates support bars 202 or 203 secured to the side surface of the storage compartment, which are another embodiment of the support unit 20.

Referring to FIG. 7(*a*), the support unit 20 may include two cantilevers 201, which extend in the front-to-back direction and are secured to the rear surface of the storage compartment. The cantilever 201 has a fixing end 201*a*, which is secured to the rear surface of the storage compartment.

The two cantilevers 201 may be arranged to support opposite sides of the horizontal frame 30, and may be arranged to support the lower surface of the horizontal frame 30.

In the case where the two cantilevers 201 are horizontally spaced apart from each other, the support unit 20 may further include a reinforcement member 201*b* which prevents distortion or lateral bending of the cantilevers 201. The reinforcement member 201*b* may be horizontally provided to connect the two cantilevers 201 in a traverse direction, and two reinforcement members 201*b* may be respectively arranged at front and rear positions of the cantilevers 201.

In the embodiment including the vertical frame 40 and the reinforcement member 201*b*, in order to ensure that the reinforcement member 201*b* is not located in the front-to-back movement path of the vertical frame 40, the vertical frame 40 may be located outside the two cantilevers 201. That is, the vertical frame 40 and the reinforcement member 201*b* may be arranged so that the front-to-back movement path of the vertical frame 40 does not cross the reinforcement member 201*b*.

Referring to FIG. 7(*b*), the support units 20 may include support bars 202 and 203, which extend in the front-to-back direction and are secured to the side surface of the storage compartment. The support units 20 may include the support bars 202 secured to one side surface of the inner cabinet 3 and the support bars 203 secured to one side surface of the partition 4. A reinforcement member (not illustrated) for increasing the strength of the surface may be provided on the side surface of the inner cabinet 3 or the side surface of the partition 4 to which the supports 202 or 203 are secured. For example, the reinforcement member may be a plate embedded in the side surface of the inner cabinet 3 or the side surface of the partition 4.

In an embodiment in which no partition 4 is provided in the storage compartment, two support bars 202 may be secured to the side surfaces of the storage compartment, i.e. the side surfaces of the inner cabinet 3 so as to support opposite sides of the horizontal frame 30.

In an embodiment in which the partition 4 is provided in the storage compartment, the support bar 202 secured to one side surface of the inner cabinet 3 may be located on one side surface of the horizontal frame 30 and the support bar 203 secured to the partition 4 may be located on the other side surface of the horizontal frame 30, so as to support the horizontal frame 30.

In another embodiment, one support bar 202 or 203 may be located on one side surface of the horizontal frame 30 and one cantilever 201 may be located on an opposite portion of the lower surface of the horizontal frame 30, so as to support the horizontal frame 30.

In the present embodiment, the partition 4 is vertically oriented at the center of the storage compartment to bisect the storage compartment. The partition 4 is secured to the bottom surface and the rear surface of the storage compartment, and the support bars 203 are secured to the side surface of the partition 4. The portion of the partition 4 at which the support bars 203 are not secured may be provided with the partition opening 4*a*.

The horizontal frame 30 may be moved forward in connection with the opening operation of the door 5, and may be moved rearward in connection with the closing operation of the door 5. The horizontal frame 30 is moved in the front-to-back direction along the support unit 20.

Referring to FIG. 6, the first rail unit 25 includes a first rail 26 or a first roller 27 provided on any one of the support unit 20 and the horizontal frame 30, and a first guide 28 provided on the other one of the support unit 20 and the horizontal frame 30. The first rail 26 or the first roller 27 is engaged with the first guide 28 so as to guide the movement of the horizontal frame 30 in the front-to-back direction.

The first rail 26 or the first roller 27 and the first guide 28 are located between the horizontal frame 30 and the support unit 20 and serve to movably support the horizontal frame 30 in the front-to-back direction.

The first rail 26 may refer to ribs that extend in the front-to-back direction, and two or more ribs may be arranged parallel to each other. The first rail 26 may protrude from the surface of any one of the support unit 20 and the horizontal frame 30, and a separate component may be assembled with the any one of the support unit 20 and the horizontal frame 30.

The first roller 27 refers to a member that rotates about a rotating shaft, and includes a disc-shaped or bead-shaped bearing.

The first guide 28 includes the upper surface to support the bottom of the first rail 26 or the first roller 27, or the lower surface to be supported by the top of the first rail 26 or the first roller 27. Specifically, when the first guide 28 is provided on the support unit 20, the upper surface of the first guide 28 supports the bottom of the first rail 26 or the first roller 27 provided on the horizontal frame 30. In addition, when the first guide 28 is provided on the horizontal frame 30, the lower surface of the first guide 28 is supported by the top of the first rail 26 or the first roller 27 provided on the support unit 20.

The first guide 28 includes a side surface to prevent the leftward or rightward movement of the horizontal frame 30. Specifically, when the first guide 28 is provided on the support unit 20, the side surface of the first guide 28 prevents the first rail 26 or the first roller 27 provided on the horizontal frame 30 from being moved leftward or rightward. In addition, when the first guide 28 is provided on the horizontal frame 30, the side surface of the first guide 28 is caught by the first rail 26 or the first roller 27 provided on the support unit 20 so as not to be moved leftward or rightward.

The first guide 28 includes a concave portion such as a stepped or recessed portion, or a convex portion such as a ribbed portion, which extends in the front-to-back direction. The first guide 28 may be recessed in or protruded from the surface of the other one of the support unit 20 and the horizontal frame 30, or may be a separate component assembled to the surface of the other one of the support unit 20 and the horizontal frame 30.

Referring to FIG. 6, in the present embodiment, the first rail 26 and the first roller 27 are provided on the horizontal frame 30. Specifically, two first rollers 27 are provided respectively on front portions of the left and right side surfaces of the horizontal frame 30 and two first rollers 27 are provided respectively on rear portions of the left and right side surfaces of the horizontal frame 30. As such, a total of four first rollers 27 is provided on the horizontal frame 30. In addition, the first rail 26 is provided to extend in the front-to-back direction at the upper side of the front first roller 27 provided on the upper horizontal frame 30*b*.

In the present embodiment, the first rail 26 includes two horizontal rail portions 26*a*, which are spaced apart from and parallel to each other and extend in the front-to-back direction. In addition, the first rail 26 includes a rail reinforcement portion 26*b*, which is located between the two horizontal rail portions 26*a* and is connected to the two horizontal rail portions 26*a*.

In addition, each of the support bars 202 and 203 secured to the side surface of the storage compartment are provided with the first guide 28, which forms a groove into which the first rollers 27 and the first rail 26 are fitted.

The connection between the opening and closing operation of the door 5 and the forward and rearward movement of the horizontal frame 30 is classified into an automated method using a motor, a manual method of mechanically connecting the door 5 and the horizontal frames 30 to each other, and a semi-automated method, which is a combination of the automated method and the manual method. In the present embodiment, the manual method in which the door 5 and the lowermost horizontal frame 30*a* are mechanically connected to each other using the link 50 is implemented.

Referring to FIG. 6, the front end of the link 50 is referred to as a door connecting portion 501, which is connected to the door 5, and the rear end of the link 50 is referred to as a frame connecting portion 502, which is connected to the lower surface of the lowermost horizontal frame 30*a*.

The door connecting portion 501 is rotatably connected to the door 5. In the present embodiment, the door connecting portion 501 is inserted into a slit, which is formed in the front-to-back direction in the lower portion of the inner surface of the door 5, and the door 5 and the door connection portion 501 are rotatably connected to each other at a door connection point 501*a* inside the slit.

The door connection point 501*a* is provided at a location spaced apart from a rotating shaft of the door 5 by a prescribed distance. As the distance between the rotating shaft of the door 5 and the door connection point 501*a* increases, the distance along which the link 50 is moved forward when the door 5 is opened increases. That is, as the radius of rotation of the door connecting portion 501 increases, the distance by which the link 50 is movable increases.

The frame connecting portion 502 is rotatably connected to the lowermost horizontal frame 30*a*. The lower surface of the lowermost horizontal frame 30*a* is provided with a frame connection point 502*a*, to which the frame connection portion 502 is rotatably connected.

In order to allow the horizontal frames 30 to be moved forward only when the opening angle of the door 5 is a prescribed angle or more, the door connection point 501*a* or the frame connection point 502*a* may be permitted to move in the horizontal direction within a limited range, or a bending point (not illustrated) to enable the link 50 to be bent in the horizontal direction may be provided at the middle between the door connecting portion 501 and the frame connecting portion 502 of the link 50.

In the present embodiment, the frame connection point 502*a* is movable in the front-to-back direction within a prescribed range along the lower surface of the lowermost horizontal frame 30*a*. The maximum limit point of the forward movement of the frame connection point 502*a* is the point at which the frame connection point 502*a* is located when the door 5 is opened by the prescribed angle. When the door 5 is opened by the prescribed angle or more, the frame connection point 502*a* cannot be moved further forward relative to the lowermost horizontal frame 30*a*, thus causing the lowermost horizontal frame 30*a* to move forward.

The frame connection point 502*a* may deviate to either of the left and right sides of the lowermost horizontal frame 30*a*, or may be located in the center of the lowermost horizontal frame 30*a*. In the present embodiment, the frame connection point 502*a* is located on one of the left and right sides of the horizontal frame 30 that is farther away from the rotating shaft of the door 5 than the other side. In this case, the distance by which the frame connection point 502*a* is movable, which happens when the door 5 is rotated by the prescribed angle or more, is increased, which may ensure the sufficient forward movement of the horizontal frame 30*a*.

In addition, the link 50 is horizontally bent or rounded in order to prevent the link 50 from being located in the rotation path of the door 5 and from interfering with the door 5 when the door 5 is rotated. In the present embodiment, the front end of the link 50 is bent so as to be rounded in a direction farther away from the rotating shaft of the door 5. In this way, when the door 5 is opened, it is possible to prevent the corner of the rear surface of the door 5 that is close to the rotating shaft of the door 5 from interfering with the link 50.

In addition, a shield cover (not illustrated) may be mounted in the storage compartment at a position in front of the region at which the link 50 is installed. The link 50 may be located below the shield cover, or may pass through a slit formed in the shield cover, so as to minimize the exposure of the link 50 to the visual field of the user.

The lowermost horizontal frame 30*a* connected to the link 50 is moved forward or rearward as the door 5 is opened or closed. Thus, when the lowermost horizontal frame 30*a* is moved forward or rearward, the upper horizontal frame 30*a* is simultaneously moved forward or rearward by the vertical frame 40 which connects the lowermost horizontal frame 30*a* and the upper horizontal frame 30*b* to each other. The vertical frame 40 is vertically oriented on the rear surface or the side surface of the horizontal frame 30. The vertical frame 40, disposed on the rear surface of the horizontal frame 30, is referred to as a rear frame 42, and the vertical frame 40, disposed on the side surface of the horizontal frame 30, is referred to as a side frame (not illustrated). Hereinafter, the respective frames will be described.

Since the horizontal frame 30 is supported by the support unit 20, the vertical frame 40 does not need to support the horizontal frame 30, and thus may have a reduced weight. Accordingly, the weight of the vertical frame 40 may be minimized within a range in which the vertical frame 40 can function to push the upper horizontal frame 30*b* forward or to pull the upper horizontal frame 30*b* rearward. With a reduction in the weight of the vertical frame 40, the area over which the vertical frame 40 covers the inner surface of the storage compartment is reduced, which is advantageous in terms of the circulation of cold air inside the storage compartment. In addition, because the weight of the vertical frame 40 is reduced, the frictional force at the location of the vertical frame 40 at which the vertical frame 40 supports the horizontal frame 30 is reduced, which allows the user to open or close the door 5 with smaller force.

When the door 5 is opened, the link 50 pulls the lowermost horizontal frame 30*a* forward, and in turn the pulled lowermost horizontal frame 30*a* pulls the vertical frame 40 forward, and finally the pulled vertical frame 40 pushes the upper horizontal frame 30*b* forward. The weight of the vertical frame 40 can be minimized, because the vertical frame 40 is not required to support the horizontal frames 30.

The rear frame 42 may have the shape of a plate or a bar. In the present embodiment, the rear frame 42 includes two vertical bars arranged at opposite sides of the horizontal frame 30. The rear frame 42 may consist of only vertical bars. The rear frame 42 may consist of only two vertical bars arranged at opposite sides of the horizontal frame 30. The vertical bar has a thickness in the front-to-back direction and a width in the left-and-right direction, the width being greater than the thickness. The smaller the thickness, the greater the efficiency of use of space in the storage compartment.

The vertical bars may extend so as to bend along the contour of the rear surface of the storage compartment. A space in which elements such as, for example, a compressor, is accommodated is defined, separately from the storage compartment, in the lower portion of the rear surface of the storage compartment at the rear side of the inner cabinet 3. To achieve the space in which, for example, the compressor is accommodated, the inner cabinet 3 may protrude forward from the lower portion of the rear surface of the storage compartment so that the rear surface of the storage compartment is curved. The rear frame 42 may be curved into a shape corresponding to the curved rear surface of the inner cabinet 3.

Among the horizontal frames 30, at least the lowermost horizontal frame 30*a* is coupled to the rear frame 42. That is, the rear frame 42 may push the upper horizontal frame 30*b* forward even when it is simply in contact with the upper horizontal frame 30*b*. On the other hand, the lowermost horizontal frame 30*a* cannot pull the rear frame 42 forward when it is simply in contact with the rear frame 42 without being coupled to the rear frame 42.

The upper horizontal frame 30*b* as well as the lowermost horizontal frame 30*a* may be coupled to the rear frame 42. In this case, when the door 5 is closed, the rear frame 42 pulls the upper horizontal frame 30*b* rearward so as to return the upper horizontal frame 30*b* to its original position.

The side frame may have the shape of a plate or a bar. In an exemplary embodiment, the side frame includes a plate located at one side of the horizontal frame 30. The plate is a member having a thickness in the left-and-right direction of the storage compartment and a width in the front-to-back direction of the storage compartment. As the width of the side frame increases, the secondary moment of the cross section in the front-to-back direction of the side frame increases. As such, the side frame achieves increased bending rigidity, which is required to push or pull the horizontal frame 30*b* in the front-to-back direction.

Connecting portions (not illustrated) for connecting the side frame and the horizontal frame 30 to each other may be formed on facing surfaces of the side frame and the horizontal frame 30. For example, a protrusion may be formed on either one of the side frame and the horizontal frame 30 and a recess for insertion of the protrusion may be formed in the other one of the side frame and the horizontal frame 30 such that the protrusion and the recess are connected to each other.

When the door 5 is opened and the link 50 pulls the lowermost horizontal frame 30*a* forward, the side frame and the upper horizontal frame 30*b*, which are connected to each other by the connecting portions, are moved forward. When the door 5 is closed and the link 50 pushes the lowermost horizontal frame 30*a* rearward, the side frame and the upper horizontal frame 30*b*, which are connected to each other by the connecting portions, are moved rearward.

The connecting portions may selectively connect or separate the side frame and the upper horizontal frame 30*b* to or from each other. When the connecting portions of the side frame and the upper horizontal frame 30*b* are separated from each other, the upper horizontal frame 30*b* is not moved even when the lowermost horizontal frame 30*a* is moved forward or rearward in response to the opening or closing operation of the door 5.

In the case where a plurality of upper horizontal frames 30*b* is provided, the connecting portions may selectively connect or separate any one or more of the upper horizontal frames 30*b* to or from the side frame. Even when the lowermost horizontal frame 30*a* is moved forward or rearward in response to the opening or closing operation of the door 5, the upper horizontal frame 30*b* separated from the side frame is not moved.

A side frame guide may be provided on the side surface of the storage compartment so as to guide the forward or rearward movement of the side frame.

In one embodiment, the side frame is disposed on either of the left and right sides of the horizontal frame 30 so as to be exposed. In the case where the support bar 202 or 203 is located on either side of the horizontal frame 30, the side frame is located so that no support bar is located in the forward or rearward movement path of the side frame. That is, the side frame has a short length so that the upper end and the lower end of the side frame are located between the two support bars 202 or 203, which are spaced apart from each other in the vertical direction. In addition, in the case where the horizontal frames 30 are provided in three or more layers, the side frame, which connects the lowermost horizontal frame 30*a* and the intermediate layer horizontal frame 30*b* located immediately above the lowermost horizontal frame 30*a* to each other, is disconnected from the side frame, which connects the intermediate layer horizontal frame 30*b* and the uppermost horizontal frame 30*b* located above the intermediate layer horizontal frame 30*b* to each other, such that the support bar 202 or 203 is arranged in the gap between the disconnected side frames so as to support the intermediate layer upper horizontal frame 30*b*.

In another embodiment, the side frame may be located in the space between the inner cabinet 3, which define the side surfaces of the storage compartment, and the outer cabinet 1, or may be located between the left and right side surfaces of the partition 4. Even in the case where the support bar 202 or 203 is located on the side of the horizontal frame 30 that faces the side frame, there is no risk of interference between the side frame and the support bar 202 or 203 because the forward or rearward movement path of the side frame is formed at the back side of the support bar 202 or 203 (i.e. the side of the support bar 202 or 203 opposite the horizontal frame 30).

In the case where the side frame is located in the space between the inner cabinet 3 and the outer cabinet 1, an elongated slit, which extends in the front-to-back direction from the position at which the connecting portion of the side frame protrudes, is formed in the inner cabinet 3 on the side thereof at which the side frame is located. When the side frame is moved in the front-to-back direction, the connecting portion is moved in the front-to-back direction along the slit.

In the case where the side frame is located between the left and right side surfaces of the partition 4, an elongated slit is formed in each side surface of the partition 4 so as to extend in the front-to-back direction at the position where the connecting portion of the side frame protrudes. When the side frame is moved in the front-to-back direction, the connecting portion moves in the front-to-back direction along the slit.

In the state in which the horizontal frame 30 is moved forward to the maximum extent in response to the opening operation of the door 5, the front end of the item storage unit 10 may be located in the same vertical plane as the front opening of the storage compartment, or may be located at the rear side of the front opening.

In the case where the distance by which the horizontal frame 30 is moved forward is limited even when the door 5 is completely opened, and in particular, the front end of the item storage unit 10 is located in the same plane as or at the rear side of the opening, the user has difficulty in visually identifying and retrieving items stored deep inside the storage compartment.

In order to eliminate the difficulty described above, the item storage unit 10 may be connected to the horizontal frame 30 so as to be movable in the front-to-back direction. This may assist the user in conveniently identifying and retrieving items stored deep inside the storage compartment.

The item storage unit 10 may be moved forward or rearward based on user selection. The item storage unit 10 is moved in the front-to-back direction along the horizontal frame 30. The second rail unit is located between the item storage unit 10 and the horizontal frame 30, and movably supports the item storage unit 10 in the front-to-back direction. The second rail unit includes a second rail 36 or a second roller provided on any one of the item storage unit 10 and the horizontal frame 30, and a second guide 38 provided on the other one of the item storage unit 10 and the horizontal frame 30. The second rail 36 or the second roller is engaged with the second guide 38 so as to guide the movement of the horizontal frame 30 in the front-to-back direction.

The second rail 36 may refer to ribs that extend in the front-to-back direction, and two or more ribs may be arranged parallel to each other. The second rail 36 may protrude from the surface of any one of the item storage unit 10 and the horizontal frame 30, and a separate component may be assembled with the any one of the item storage unit 10 and the horizontal frame 30.

The second roller refers to a member that rotates about a rotating shaft, and includes a disc-shaped or bead-shaped bearing.

The second guide 38 includes the upper surface to support the bottom of the second rail 36 or the second roller, or the lower surface to be supported by the top of the second rail 36 or the second roller. Specifically, when the second guide 38 is provided on the horizontal frame 30, the upper surface of the second guide 38 supports the bottom of the second rail 36 or the second roller provided on the item storage unit 10. In addition, when the second guide 38 is provided on the item storage unit 10, the lower surface of the second guide 38 is supported by the top of the second rail 36 or the second roller provided on the horizontal frame 30.

The second guide 38 includes a side surface to prevent the leftward or rightward movement of the item storage unit 10. Specifically, when the second guide 38 is provided on the horizontal frame 30, the side surface of the second guide 38 prevents the second rail 36 or the second roller 37 provided on the item storage unit 10 from being moved leftward or rightward. In addition, when the second guide 38 is provided on the item storage unit 10, the side surface of the second guide 38 is caught by the second rail 36 or the second roller provided on the horizontal frame 30 so as not to be moved leftward or rightward.

The second guide 38 includes a concave portion such as a stepped or recessed portion, or a convex portion such as a ribbed portion, which extends in the front-to-back direction. The second guide 38 may be recessed in or raised from the surface of the other one of the item storage unit 10 and the horizontal frame 30, or may be a separate component assembled to the surface of the other one of the item storage unit 10 and the horizontal frame 30.

The item storage unit 10 may be selectively separably connected to the horizontal frame 30. It is convenient for the user to place items in the item storage unit 10 in the state in which the item storage unit 10 is separated from the refrigerator as needed. In particular, this function is important in the refrigerator that includes a large-capacity item storage unit 10 in which a great amount of items may be placed.

There are various methods of connecting or separating the item storage unit 10. The item storage unit 10 is able to be separated from the horizontal frame 30, along with the second rail 36, the second roller or the second guide 38, which is provided on the item storage unit 10. Alternatively, a separate connection/separation device may be provided between the item storage unit 10 and the second rail 36, the second roller or the second guide 38 provided on the item storage unit 10.

Referring to FIG. 6, in the present embodiment, a connection/separation bracket 391 and the second rail 36 are provided on the item storage unit 10, and the second guide 38 is secured to the horizontal frame 30.

Referring to FIG. 6, in the present embodiment, the second rail 36 is constructed such that two rail ribs, which are vertically spaced apart from each other by a small distance, extend in the front-to-back direction. The second guide 38 is constructed such that two guide ribs, which are vertically spaced apart from each other by a distance, which is greater than the distance between the two rail ribs, extend in the front-to-back direction. The two rail ribs are fitted in the distance between the two guide ribs, and thus the movement of the second rail 36 is permitted only in the front-to-back direction. As the number of the stacked rail ribs of the second rail 36 or the length of the rail ribs increase, the distance by which the is constructed such that two ribs, which are vertically spaced apart from each other by the item storage unit 10 is movable forward may increase.

The connection/separation bracket 391 is coupled to the second rail 36. A single second rail unit is organized via assembly of the connection/separation bracket 391, the second rail 36 and the second guide 38. The connection/separation bracket 391 is selectively separated from the main body of the item storage unit 10.

The connection/separation bracket 391 is provided with a holding rib 391*a* and a holding protrusion 391*b*. The holding rib 391*a* is formed on the upper surface of a horizontally protruding portion at the rear end of the connection/separation bracket 391, and the holding protrusion 391*b* is formed on the side surface that faces the item storage unit 10 at a position near the front end of the connection/separation bracket 391. The holding rib 391*a* has an "L"-shape and is bent forward, and the holding protrusion 391*b* is downwardly inclined.

A bracket mount 392 is formed on either side surface of the item storage unit 10 so as to be coupled to the connection/separation bracket 391. The bracket mount 392 protrudes from the side surface of the item storage unit 10 so that the lower surface thereof comes into contact with the upper surface of the connection/separation bracket 391. The bracket mount 392 is provided with a holding rib mounting piece 392*a* and a holding protrusion mounting piece 392*b* at positions respectively corresponding to the holding rib 391*a* and the holding protrusion 391*b* of the connection/separation bracket 391. As such, the holding rib mounting piece 392*a* is formed on the rear end portion of the bracket mount 392, and the holding protrusion mounting piece 392*b* is formed on the front end portion of the bracket mount 392.

The holding rib mounting piece 392*a* includes a front-to-back rib, which may be horizontally inserted rearward into the L-shaped bent portion of the holding rib 391*a*. An additional rib protrudes upward from the front-to-back rib and serves to cause the holding rib mounting piece 392*a* to stop when the holding rib mounting piece 392*a* is inserted into the holding rib 391*a* by a prescribed depth.

The holding protrusion mounting piece 392*b* includes a protrusion, which protrudes toward the connection/separation bracket 391. The holding protrusion mounting piece 392*b* may be connected to the connection/separation bracket 391 when the protrusion of the holding protrusion mounting piece 392*b* is inserted into the portion of the downwardly inclined holding protrusion 391*b* that protrudes to the minimum extent.

A method of separating the item storage unit 10 from the bracket mount 392 is as follows. The front end of the item storage unit 10 is lifted so that the holding protrusion mounting piece 392*b* is separated from the holding protrusion 391*b*. Thereafter, the item storage unit 10 is pulled forward so as to separate the holding rib mounting piece 392*a* is separated from the holding rib 391*a*.

Hereinafter, the operations of the door 5, the link 50, the vertical frame 40, the horizontal frame 30, and the item storage unit 10 will be described with reference to FIGS. 8 to 10. FIG. 8 is a conceptual elevation view of the interior of the storage compartment, illustrating positions of the item storage units 10 and the horizontal frames 30 when the door 5 is closed in accordance with one embodiment of the present invention. FIG. 9 is a conceptual elevation view of the interior of the storage compartment, illustrating positions of the item storage units 10 and the horizontal frames 30 when the door 5 is opened. FIG. 10 is a conceptual elevation view of the interior of the storage compartment, illustrating positions of the item storage units 10 after being forwardly moved from the horizontal frames 30 in the state in which the door 5 is open.

Referring to FIG. 8, when the door 5 is closed, the horizontal frames 30 are introduced into the storage compartment at the rearmost positions thereof.

Referring to FIG. 9, when the door 5 is opened, the door connecting portion 501 of the link 50 is moved forward and the frame connecting portion 502 is also moved forward.

The frame connecting portion 502 pulls the lowermost horizontal frame 30 forward, and the lowermost horizontal frame 30 pulls the rear frame 42 coupled thereto forward. The rear frame 42 pushes the other horizontal frames 30 forward. In this way, when the door 5 is rotated and opened by a prescribed angle or more, the front ends of all of the item storage units 10 are located near the opening of the storage compartment.

Referring to FIG. 10, when the user pulls a desired item storage unit 10 forward, the pulled item storage unit 10 is moved forward along the horizontal frame 30. Consequently, the front end of the pulled item storage unit 10 is located at a position that is much farther forward than the opening in the storage compartment.

Since the rear frame 42 is coupled to all of the multiple layers of horizontal frames 30, all of the horizontal frames 30 are moved rearward to return to the original positions thereof when the door 5 is closed. Specifically, when the door 5 is closed, the door connecting portion 501 of the link 50 is moved rearward and the frame connecting portion 502 is also moved rearward. The frame connecting portion 502 pushes the lowermost horizontal frame 30 rearward, and the lowermost horizontal frame 30 pushes the rear frame 42 coupled thereto rearward. The rear frame 42 pulls the other horizontal frames 30 rearward.

In the case where a hinge junction point of the door connecting portion 501 or the frame connecting portion 502 of the link 50 is connected so as to be horizontally movable in a prescribed direction by a prescribed distance, or in the case where the link 50 has a joint, the horizontal frames 30 may be set so as to be stationary, rather than being moved forward, even when the door 5 is rotated and opened by a first set angle.

Although the preferred embodiments of the present invention have been illustrated and described, the present invention is not limited to the above described particular embodiments, and various modifications, additions and substitutions are possible by those skilled in the art without departing from the scope and spirit of the invention as disclosed in the accompanying claims. All the modifications, additions and substitutions are not intended to be understood individually from the technical sprit or outlook of the present invention.

The invention claimed is:

1. A refrigerator comprising:

an inner cabinet that is configured to define a storage compartment with a front opening;

a door that is configured to open or close the opening;

item storage units arranged in multiple layers, the item storage units being accommodated in the storage compartment;

horizontal frames arranged in multiple layers, the horizontal frames configured to respectively support the item storage units arranged in multiple layers;

a vertical frame coupled to each of the horizontal frames arranged in multiple layers, the vertical frame configured to extend vertically;

first rail units arranged in multiple layers, the first rail units configured to support the horizontal frames to allow the horizontal frames to move in a front-to-back direction relative to the storage compartment;

a link that is configured to connect any one of the horizontal frames arranged in multiple layers and the door to each other, to allow the horizontal frames to move in the front-to-back direction in response to rotation of the door; and a second rail unit located between the item storage unit and the horizontal frame arranged in the same layer, and that is configured to movably support the item storage unit in the front-to-back direction, wherein the vertical frame defines a pair of rear frames vertically oriented on a rear side of the horizontal frame, and wherein the pair of rear frames are arranged in a left-and-right direction about the horizontal frame.

2. The refrigerator according to claim 1, wherein the item storage units respectively have a front end located in the same vertical plane as the opening or located at a rear side of the opening in a state in which the horizontal frames are moved forward to a maximum extent.

3. The refrigerator according to claim 1, wherein the item storage units are selectively separably connected to the respective horizontal frames.

4. The refrigerator according to claim 1, wherein at least two of the first rail units are arranged on opposite sides of the horizontal frame to support the horizontal frame.

5. The refrigerator according to claim 1, wherein at least one of the first rail units includes a support bar that is secured to a side surface of the storage compartment.

6. The refrigerator according to claim 1, wherein the link is provided to connect a lowermost horizontal frame to the door.

7. The refrigerator according to claim 1, wherein the vertical bars have a thickness in the front-to-back direction and a width in a left-and-right direction, the width being greater than the thickness.

8. A refrigerator comprising:

an inner cabinet that is configured to define a storage compartment with a front opening;

a door configured to open or close the opening;

item storage units arranged in multiple layers, the item storage units being accommodated in the storage compartment;

horizontal frames arranged in multiple layers, the horizontal frames configured to respectively support the item storage units arranged in multiple layers;

a vertical frame coupled to each of the horizontal frames arranged in multiple layers, the vertical frame configured to extend vertically;

first rail units arranged in multiple layers, the first rail units configured to support the horizontal frames to allow the horizontal frames to move in a front-to-back direction relative to the storage compartment;

a link that is configured to connect any one of the horizontal frames arranged in multiple layers and the door to each other, to allow the horizontal frames to move in the front-to-back direction in response to rotation of the door; and a second rail unit located between the item storage unit and the horizontal frame arranged in the same layer, and that is configured to movably support the item storage unit in the front-to-back direction, wherein the vertical frame defines a rear frame vertically oriented on a rear side of the horizontal frame, wherein the inner cabinet protrudes forward from a lower portion of a rear surface of the storage compartment so that the rear surface of the storage compartment is curved, and wherein the rear frame is curved into a shape corresponding to the rear surface of the storage compartment.

* * * * *